US008893424B2

(12) United States Patent
Haering

(10) Patent No.: US 8,893,424 B2
(45) Date of Patent: Nov. 25, 2014

(54) TELESCOPIC SIGHT MOUNT WITH ADJUSTABLE FORWARD TILT

(71) Applicant: G. Recknagel e.K. Precision Tradition Technology, Bergrheinfeld (DE)

(72) Inventor: Walter Haering, Schweinfurt (DE)

(73) Assignee: G. Recknagel E.K. Precision Tradition Technology, Bergrheinfeld (DE)

( * ) Notice: Subject to any disclaimer, the term of this patent is extended or adjusted under 35 U.S.C. 154(b) by 0 days.

(21) Appl. No.: 13/769,590

(22) Filed: Feb. 18, 2013

(65) Prior Publication Data

US 2014/0157648 A1 Jun. 12, 2014

(30) Foreign Application Priority Data

Dec. 11, 2012 (DE) ..... 20 2012 011 835 U

(51) Int. Cl.
*F41G 1/387* (2006.01)
*F41G 11/00* (2006.01)

(52) U.S. Cl.
CPC ..... *F41G 1/387* (2013.01); *F41G 11/005* (2013.01); *F41G 11/003* (2013.01)
USPC ..... 42/126

(58) Field of Classification Search
CPC ... F41G 11/005; F41G 11/006; F41G 11/007; F41G 11/008; F41G 1/387
USPC ..... 42/124, 125, 126
See application file for complete search history.

(56) References Cited

U.S. PATENT DOCUMENTS

| | | | | |
|---|---|---|---|---|
| 1,330,002 | A | | 2/1920 | Price |
| 2,663,083 | A | * | 12/1953 | Harms ..... 42/126 |
| 2,881,524 | A | | 4/1959 | Simeone et al. |
| 2,951,292 | A | | 9/1960 | Buehler |
| 3,270,418 | A | | 9/1966 | Simeone et al. |
| 3,340,614 | A | | 9/1967 | Leatherwood |
| 3,471,932 | A | * | 10/1969 | Luning ..... 42/126 |
| 4,317,304 | A | | 3/1982 | Bass |
| 5,086,566 | A | | 2/1992 | Klumpp |
| 5,274,941 | A | | 1/1994 | Moore |
| 5,400,539 | A | | 3/1995 | Moore |
| 5,428,915 | A | | 7/1995 | King |
| 6,662,486 | B2 | | 12/2003 | Komberger |
| 7,121,037 | B2 | | 10/2006 | Penney |
| 7,140,143 | B1 | | 11/2006 | Ivey |
| 7,543,405 | B1 | | 6/2009 | Ivey |
| 7,661,223 | B2 | | 2/2010 | Dudney |
| 8,079,171 | B2 | | 12/2011 | Barrett |

(Continued)

FOREIGN PATENT DOCUMENTS

| | | | |
|---|---|---|---|
| AT | 512279 | A4 | 7/2013 |
| DE | 29502840 | U1 | 4/1995 |

(Continued)

*Primary Examiner* — Stephen M Johnson
(74) *Attorney, Agent, or Firm* — Abel Law Group, LLP

(57) ABSTRACT

Disclosed is a telescopic sight mount with adjustable forward tilt. The mount comprises a basic body and an attachment and the basic body and the attachment, by virtue of an arrangement of a clamping screw at an angle greater than a self-locking of a material pairing and less than 90°, have a positive connection. Also disclosed is a telescopic sight mount with adjustable forward tilt wherein the mount comprises a basic body and an attachment and the basic body and the attachment comprise a tapered joint.

13 Claims, 12 Drawing Sheets

Section B-B

(56) References Cited

U.S. PATENT DOCUMENTS

| | | | | |
|---|---|---|---|---|
| 8,079,172 | B2 | 12/2011 | Dudney | |
| 8,240,075 | B1 | 8/2012 | Mullin | |
| 2004/0144013 | A1 | 7/2004 | Leatherwood | |
| 2009/0031610 | A1 | 2/2009 | Dudney | |
| 2010/0107705 | A1 | 5/2010 | Dudney | |
| 2010/0162611 | A1* | 7/2010 | Samson et al. | 42/125 |
| 2010/0275497 | A1* | 11/2010 | Brentzel | 42/125 |
| 2012/0060401 | A1 | 3/2012 | Neufeld | |

FOREIGN PATENT DOCUMENTS

| | | | |
|---|---|---|---|
| DE | 202009017398 | U1 | 5/2010 |
| DE | 202009003210 | U1 | 7/2010 |
| DE | 202010003668 | U1 | 11/2010 |
| WO | 9634248 | A1 | 10/1996 |

* cited by examiner

Section A-A

Section B-B

Section D-D

Section C-C

TELESCOPIC SIGHT MOUNT WITH ADJUSTABLE FORWARD TILT

The present application claims priority under 35 U.S.C. 119 of German Utility Model Application 20 2012 011 835.8, filed Dec. 11, 2012, the entire disclosure of which is expressly incorporated by reference herein.

BACKGROUND OF THE INVENTION

1. Field of the Invention

The invention relates to a telescopic sight mount with adjustable forward tilt in order to be able, in long-distance firing, to change the forward tilt angle between telescopic sight and barrel in such a way that the vertical adjustment travel of the telescopic sight is sufficient to be able to set it to the desired firing distance.

2. Discussion of Background Information

Following firing from a firearm, the projectile follows a trajectory whose curvature is dependent on various influence factors, such as projectile weight and projectile velocity. Following sighting of the weapon to 100 m, for example, the telescopic sight can be adapted to various firing distances by an adjustment of the reticle. The adjustment path of each telescopic sight is mechanically limited, however, so that only a distance range of about 50-600 m, for example, can be covered. If the desired firing distance lies outside this range, for example at around 800 m, this can no longer be achieved by an adjustment of the reticle.

Telescopic sights are connected to the firearm with the aid of telescopic sight mounts. Normally, the optical axis of the telescopic sight and the barrel bore axis of the weapon here lie coaxially to each other. Due to the trajectory of the projectile, which strongly decreases in the event of large distances to the target, the telescopic sight is in some cases mounted on the weapon with a forward-tilted telescopic sight mount. Given different combinations of ammunition, barrel, weapon system, telescopic sight mount, telescopic sight and desired firing distance used, different angles of forward tilt are necessary to ensure that the available vertical adjustment path of the telescopic sight is sufficient to set the reticle to different firing distances.

If the telescopic sight is mounted with a telescopic sight mount which has a fixed forward tilt of, for example, 20 MOA (Minutes Of Angle), then this combination can be suitable for a specific application. Given a different combination, another forward tilt angle may be necessary, however, to enable the reticle of the telescopic sight to be set to the desired firing distance.

This problem can be addressed by the provision of a plurality of telescopic sight mounts having different fixedly integrated forward tilts. This calls, however, for a corresponding variety of parts and matching stock keeping. Moreover, the telescopic sight mount having the appropriate forward tilt would have to be found by trial and error, i.e. by repeated remounting. A substantially simpler and more practicable solution to this problem is a telescopic sight mount in which the tilt is adjustable.

Various telescopic sight mounts in which the forward tilt can be altered or adjusted are known:

In U.S. Pat. No. 2,951,292 a telescopic sight mount in which the tilt can be adjusted by horizontally arranged wheels is described.

According to U.S. Pat. No. 3,340,614, the tilt of the telescopic sight is adjusted by the turning of an adjusting wheel arranged around the telescopic sight body.

According to US 2004/0144013 A1, the tilt of the telescopic sight is adjusted by a vertically arranged tower.

According to German Utility Model No. DE 20 2010 003 668 U1, the tilt of the telescopic sight is defined by the installation of different inlays.

According to U.S. Pat. No. 4,317,304, the tilt of the telescopic sight is adjusted by the operation of a lever.

According to U.S. Pat. No. 2,663,083, the tilt of the telescopic sight is set by a vertically arranged adjusting screw.

According to U.S. Pat. No. 5,086,566, the tilt of the telescopic sight is altered by virtue of a component part which is built into the ring of the telescopic sight mount having a vertically arranged slot and being passed through horizontally and transversely to the firing direction by a clamping screw, which is displaced along the slot.

According to U.S. Pat. No. 5,400,539, a plurality of freely selectable tilt angles are stored by individually adjustable screws.

According to U.S. Pat. No. 5,428,915, the tilt of the telescopic sight is altered by connection of the mounting rings to the mounting bases in various positions by means of screws.

According to U.S. Pat. No. 7,121,037 B2, the tilt of the telescopic sight is set by a horizontally arranged wheel, which has on one side a threaded shank having a right-hand thread and on the other side a threaded shank having a left-hand thread.

According to U.S. Pat. No. 6,662,486 B2, the tilt of the telescopic sight is altered by a grooved cam.

According to U.S. Pat. No. 7,140,143 B1, the tilt is altered by the displacement of a shaft.

According to U.S. Pat. No. 8,079,171 B2, the tilt is altered by pinning.

According to U.S. Pat. No. 7,543,405 B1, the tilt is altered, as already in the above-stated patent of the same inventor, by the displacement of a shaft.

U.S. Pat. No. 8,240,075 B1, the tilt is altered by a horizontally arranged adjusting wheel.

The entire disclosures of all of the above documents are incorporated by reference herein.

A telescopic sight mount with adjustable forward tilt can be used in hunting or in sport shooting. In particular, however, on militarily used weapons having particularly long range and correspondingly high-performance calibers, such a mount brings significant benefits for the user.

An obvious construction of a telescopic sight mount of this kind consists of a hinged portion and a portion having an adjusting mechanism. Known hinges, as described in U.S. Pat. Nos. 8,079,172 B2, 8,240,075 B1, 7,543,405 B1, 7,140,143 B1, 6,662,486 B2, 5,400,539, 5,086,566, 4,317,304, and 3,340,614, DE 20 2010 003 668 U1, US 2004/0144013 A1, have two component parts, which, in conjunction with a cylindrical shaft or a screw, form the hinge. In order to ensure the working of the hinge, the shaft or screw in at least one of the two parts must have a slight radial play. Although, in precisely worked hinge joints, this play is very small, it can lead during use to losses of precision if the generated forces are large enough and the shaft is radially displaced within the borehole within the scope of this play. The axial clamping of the hinge by means of a screw joint ultimately constitutes, due to the necessary play of the shaft in one of the component parts, a non-positive and not a positive connection.

Absolute reliability and robustness under extremely rough usage conditions is of crucial importance, particularly in the case of militarily used weapons. In order to achieve this, the telescopic sight mount should consist of as few individual parts as possible and the connection of the individual components should be positive and not non-positive. Moreover, as few losable parts as possible should be used, which means that the telescopic sight mount does not have to be dismantled, or removed from the weapon, in order to set the forward tilt. A simplest possible execution of the adjustment is also of particular importance in order that operating errors can as far as possible be precluded.

It would be advantageous to be overcome the drawbacks of the known devices.

SUMMARY OF THE INVENTION

The present invention provides a telescopic sight mount with adjustable forward tilt wherein the basic body and an attachment, by virtue of an arrangement of a clamping screw at an angle greater than the self-locking of the material pairing and less than 90°, have a positive connection.

In one aspect of the mount, the mount may comprise an extension that may comprise a circular pivot, on which an adjusting wheel may be rotatably mounted. The adjusting wheel may have on its periphery a plurality of plane surfaces. Further, a specific angle of forward tilt may be assigned to each distance of a plane surface to the rotational axis of the adjusting wheel and/or a shell surface of the adjusting wheel may have a pitch in the form of a spiral.

In another aspect, the telescopic sight mount may comprise at least two clamping screws. For example, one clamping screw may extend through a hinge axis and a further clamping screw may extend through a circular pivot.

In yet another aspect of the mount, it may be possible to hold the basic body and the attachment under tensile stress by a tension spring.

The present invention also provides a telescopic sight mount with adjustable forward tilt wherein the mount comprises a basic body and an attachment and the basic body and the attachment comprise a tapered joint.

In one aspect, the mount may comprise at least two clamping screws. For example, one clamping screw may extend through a hinge axis and a further clamping screw may extend through a circular pivot.

In another aspect of the mount, it may be possible to hold the basic body and the attachment under tensile stress by a tension spring.

BRIEF DESCRIPTION OF THE DRAWINGS

A particularly advantageous embodiment is explained in greater detail below with reference to the Figures, wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
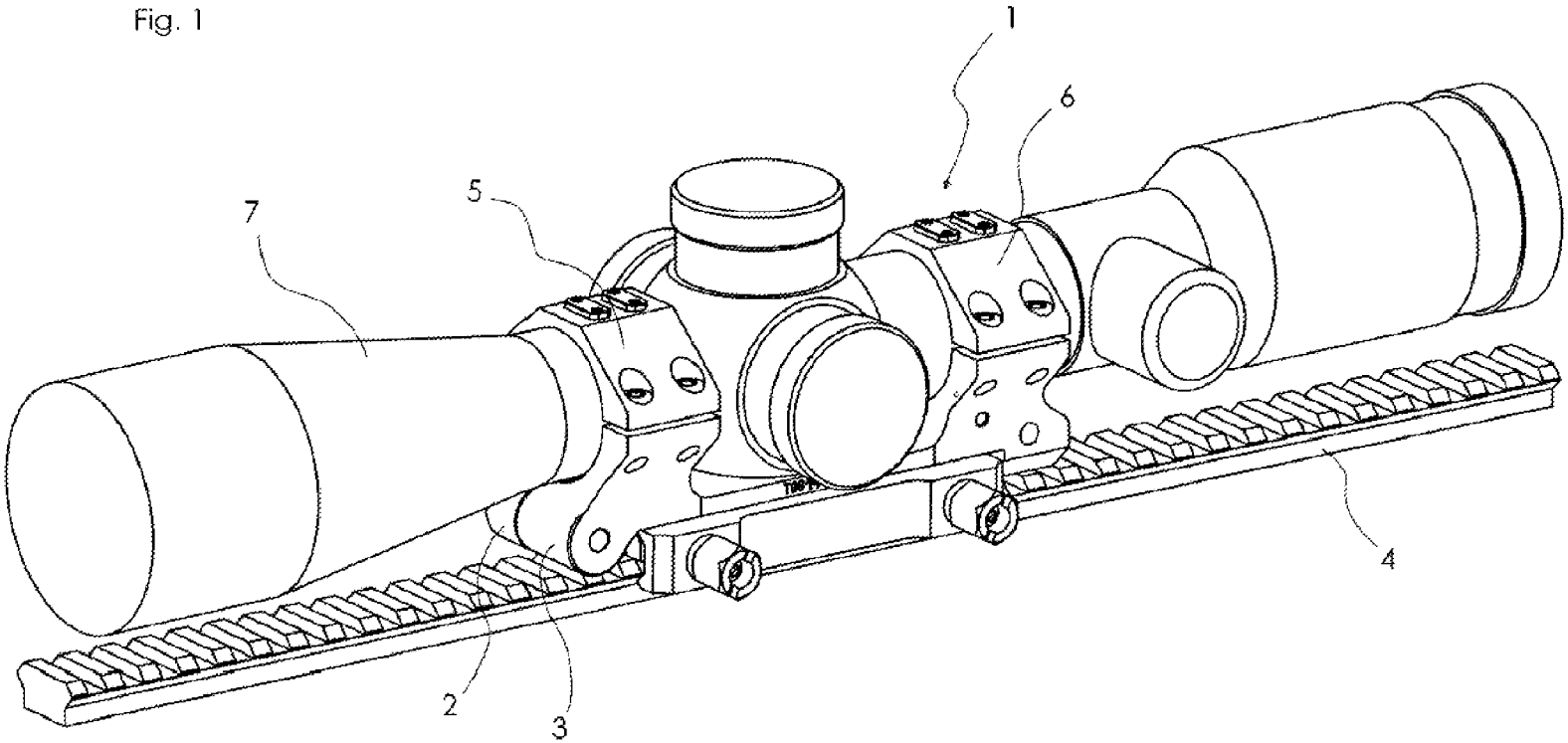
FIG. 1 shows an inventive telescopic sight mount 1 in perspective representation, mounted on a Picatinny rail 4.
Figure 2:
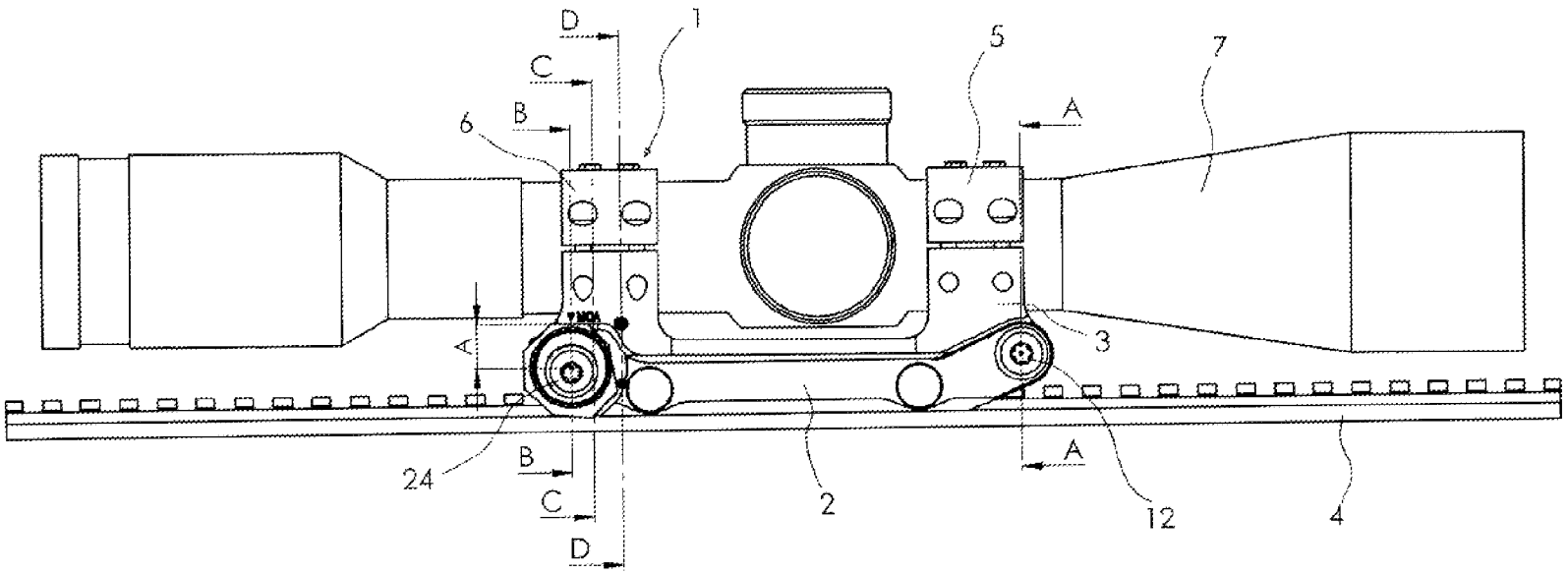
FIG. 2 shows a side view from the right, indicating the sectional planes of the telescopic sight mount 1.

FIGS. 1 and 2 show a telescopic sight mount 1, the basic body 2 of which is provided, by way of example, with a clamping system described in German Utility Model DE 20 2009 017 398.4, the entire disclosure of which is incorporated by reference herein, wherein the basic body is fastened by means of the clamping system on a Picatinny rail 4. The Picatinny rail is in turn fastened on the housing of the firearm (not shown in the Figures). Other types of fastening, for example the pivot mount which is very widely used in hunting weapon construction, or else various types of roll-off mounts and fixed mounts, are possible as connection to the weapon. The mount 3 clamps, together with the front half-shell 5 and the rear half-shell 6, the telescopic sight 7. Other types of connection between sighting device and attachment 3 are also possible. The top side of the attachment 3 can be provided, for example, also with a further Picatinny rail, on which the sighting device is mounted.

Figure 3:
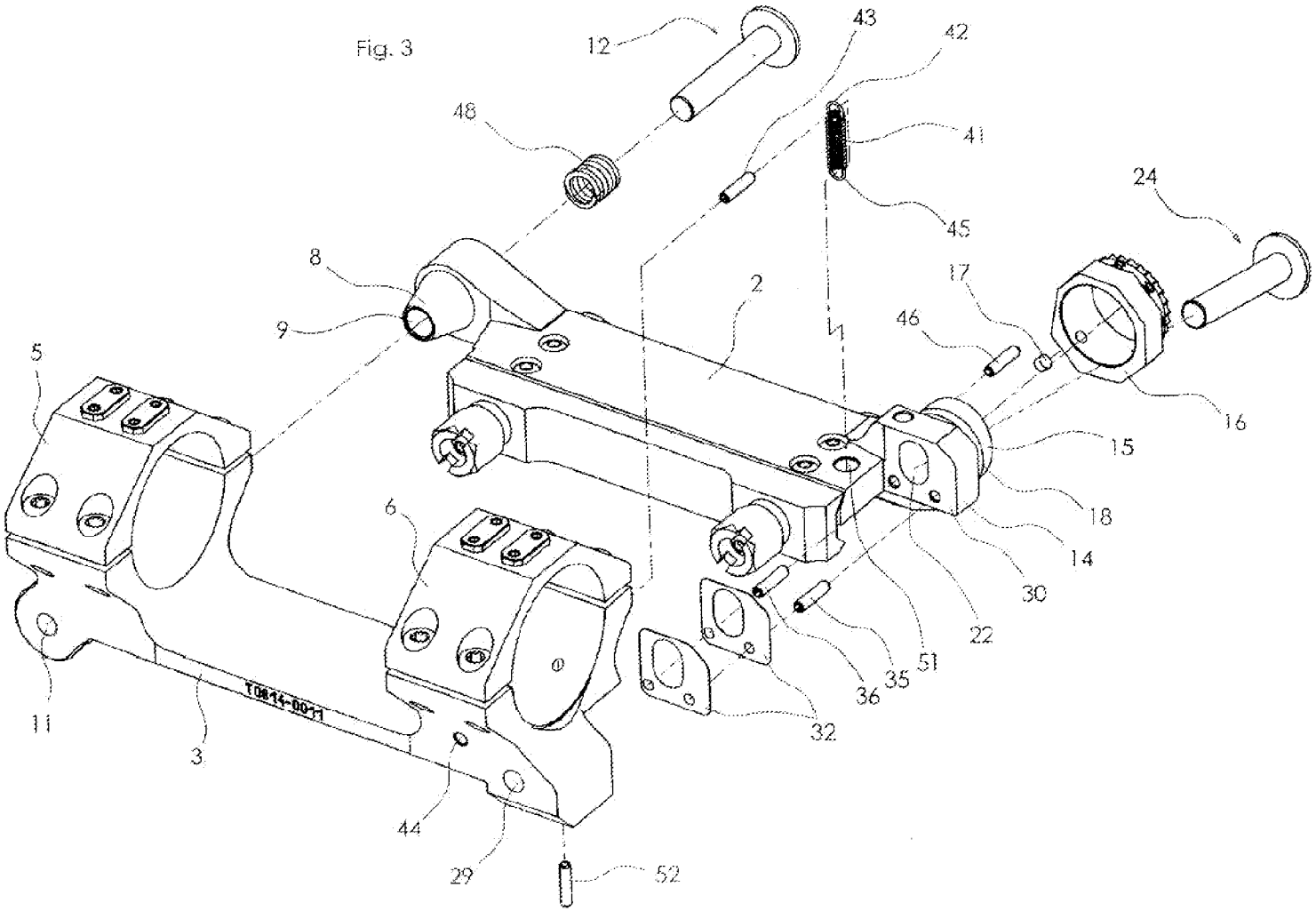
FIG. 3 shows a first exploded drawing of the inventive telescopic sight mount 1.

The basic body 2 has a tapered pivot 8 having a borehole 9 (see FIG. 3). The attachment 3 has a countersink 10 (see FIG. 4) and an internal thread 11 (see FIG. 3).

Figure 5:
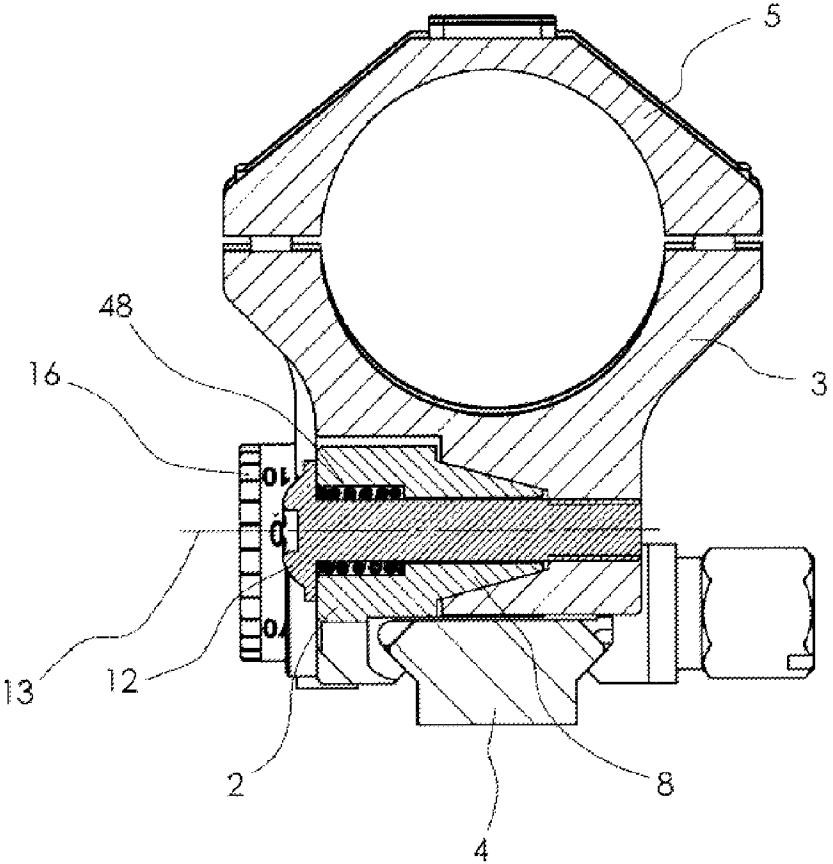
FIG. 5 shows a sectional representation through the hinge.

In the built-in state (see FIG. 5), the tapered pivot 8 is situated in the countersink 10. The first clamping screw 12 thus connects the basic body 2 in a play-free manner to the attachment 3. The basic body 2 forms with the attachment 3 a hinge about the hinge axis 13. In contrast to a connection to a cylindrical hinge pin, in the case of a tapered joint absolute freedom from play is guaranteed, which constitutes a big advantage.

Figure 6:
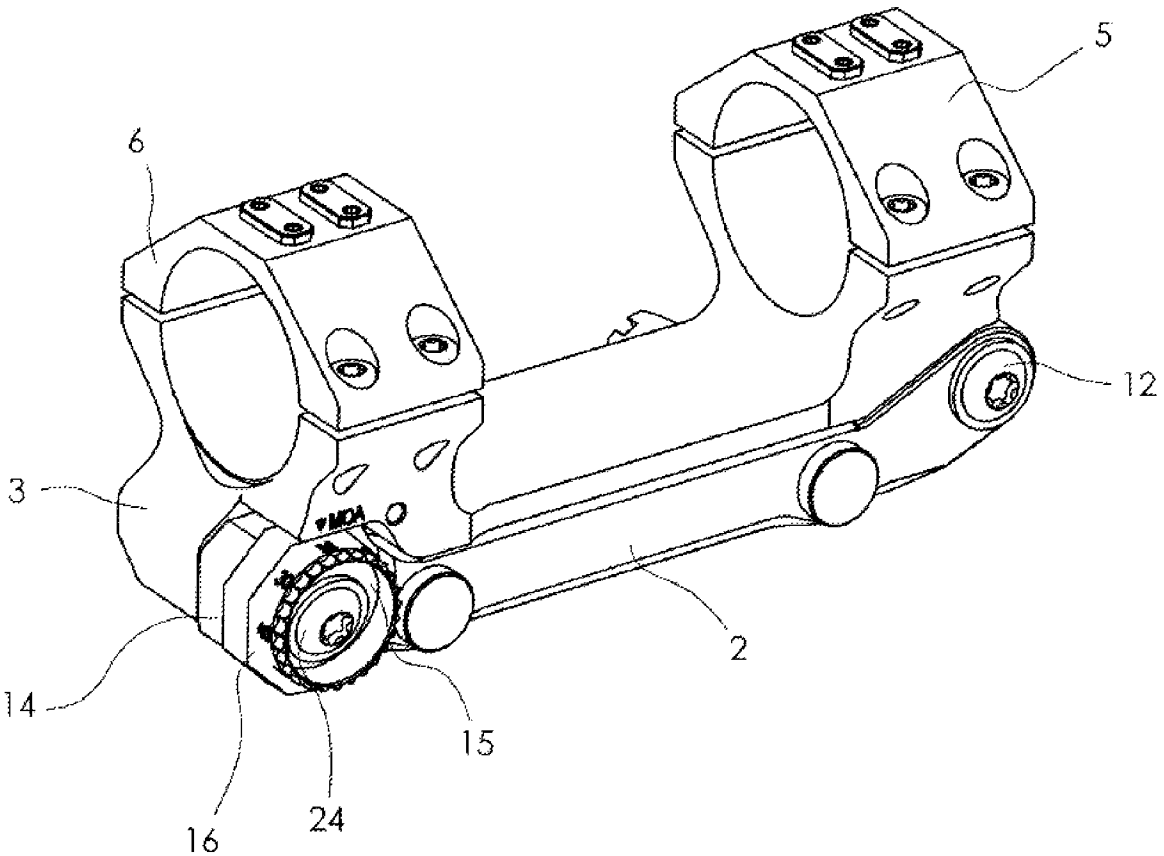
FIG. 6 shows a perspective representation of the attachment 3, with a view of the adjusting wheel 16.

The basic body 2 has an extension 14 and this in turn has a circular pivot 15, on which the adjusting wheel 16 is rotatably mounted (see FIG. 6). The threaded pin 17, which engages in the annular groove 18 of the circular pivot 15 (see FIG. 7), serves as a loss prevention device for the adjusting wheel 16. The threaded pin 17 is secured against twisting with locking varnish in the internal thread 19 (see FIG. 8).

The adjusting wheel 16 has on its periphery, for example, eight plane surfaces with associated inscriptions. The surface 20, to which the inscription "20" is assigned is singled out in order to illustrate the working. A specific angle of forward tilt is assigned to each surface. The necessary distance "A", in FIG. 8, of the surfaces to the rotational axis of the adjusting wheel 16 can be calculated via angle functions. In the embodiment which is shown by way of example, eight possible angular settings from 0 to 70 MOA in ten MOA steps are obtained. Other numbers of surfaces with other increments are possible. Equally, the shell surface of the adjusting wheel 16 can have a pitch in the form of a spiral (not shown in the Figures) in order to allow continuous adjustment of the tilt angle. For tool-free handling, the adjusting wheel 16 is provided with a corrugation 21.

Figure 7:
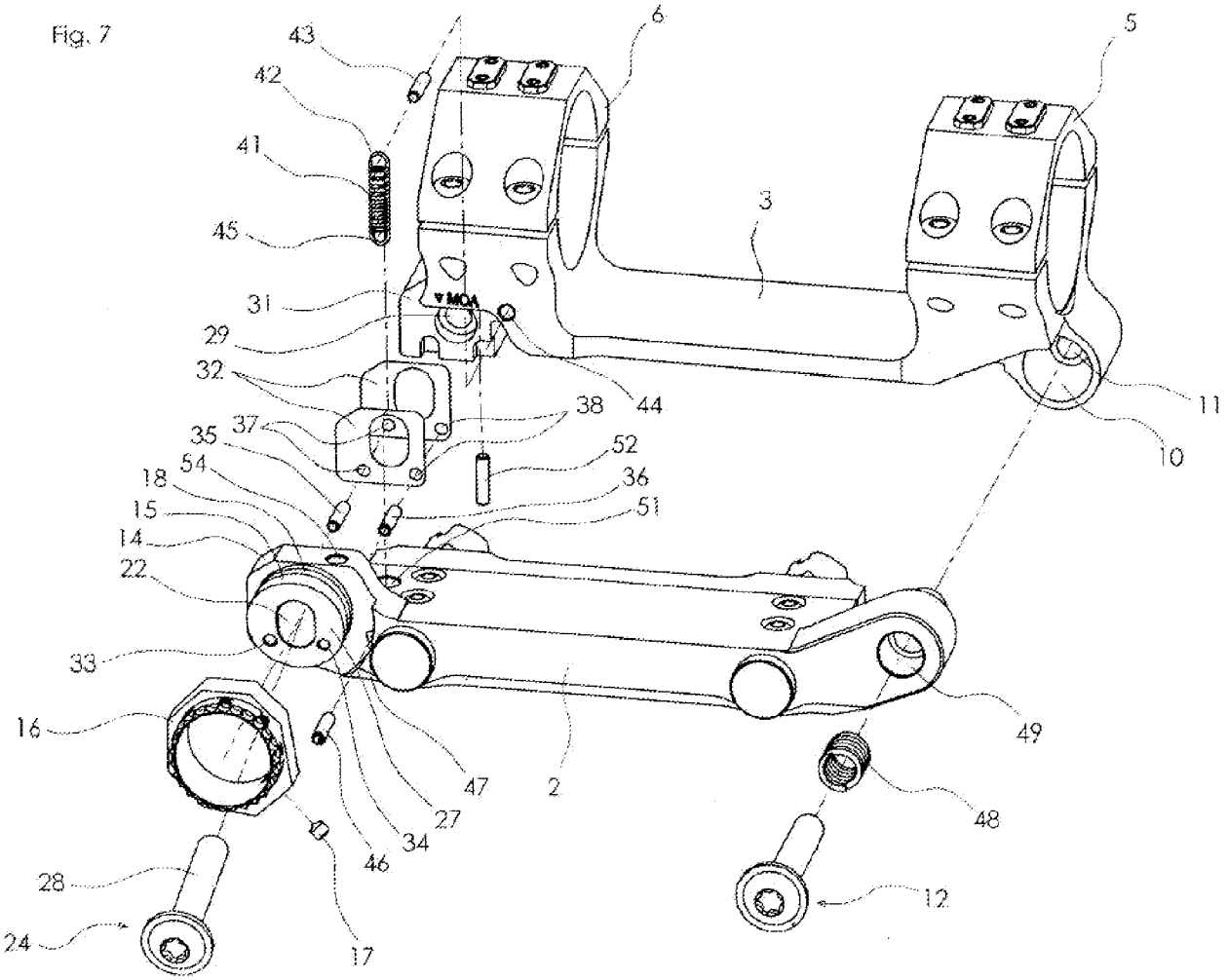
FIG. 7 shows a second exploded drawing of the inventive telescopic sight mount 1.
Figure 8:
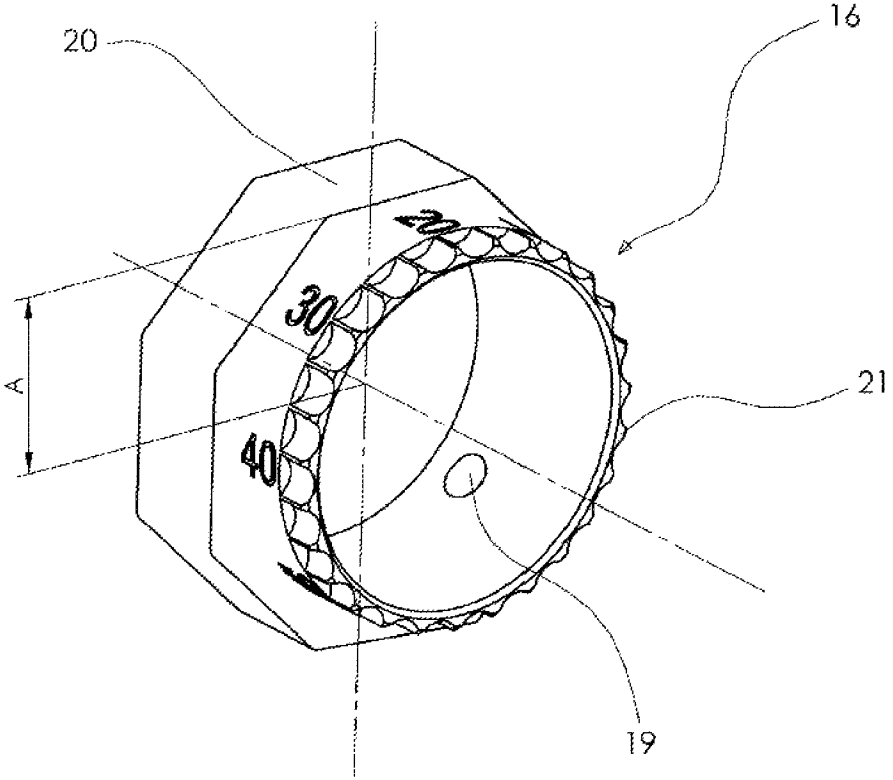
FIG. 8 shows a perspective representation of the adjusting wheel 16.
Figure 9:
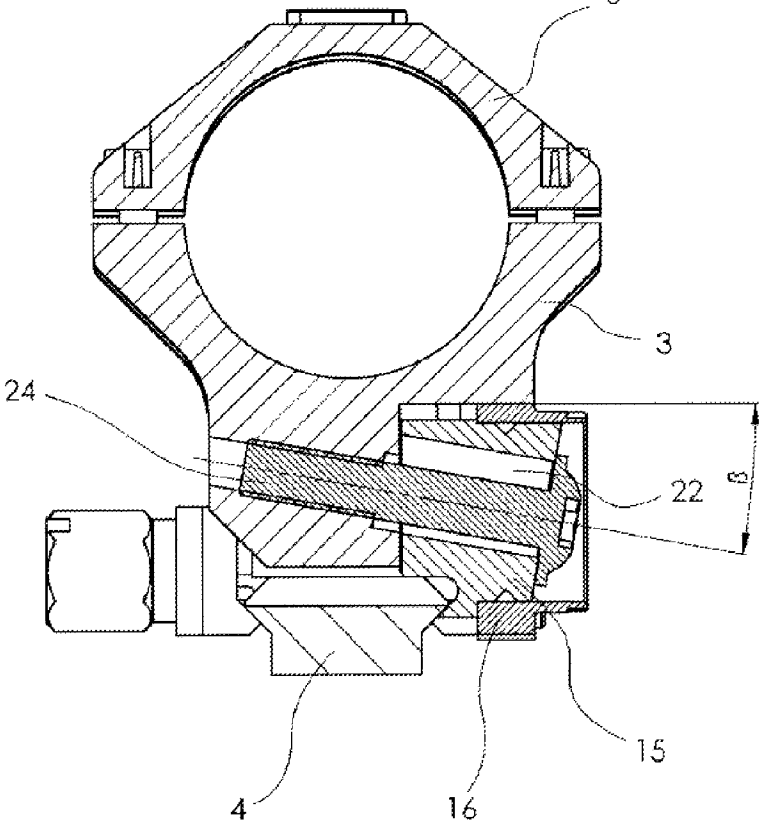
FIG. 9 shows a sectional representation through the region of the adjusting wheel 16 comprising the second clamping screw 24.

From FIG. 7 it can be seen that a slot 22 extends through the circular pivot 15 and the extension 14. This slot 22 has an angle β to the bearing surface 23 on the attachment 3 (see FIGS. 4 and 9).

Figure 10:
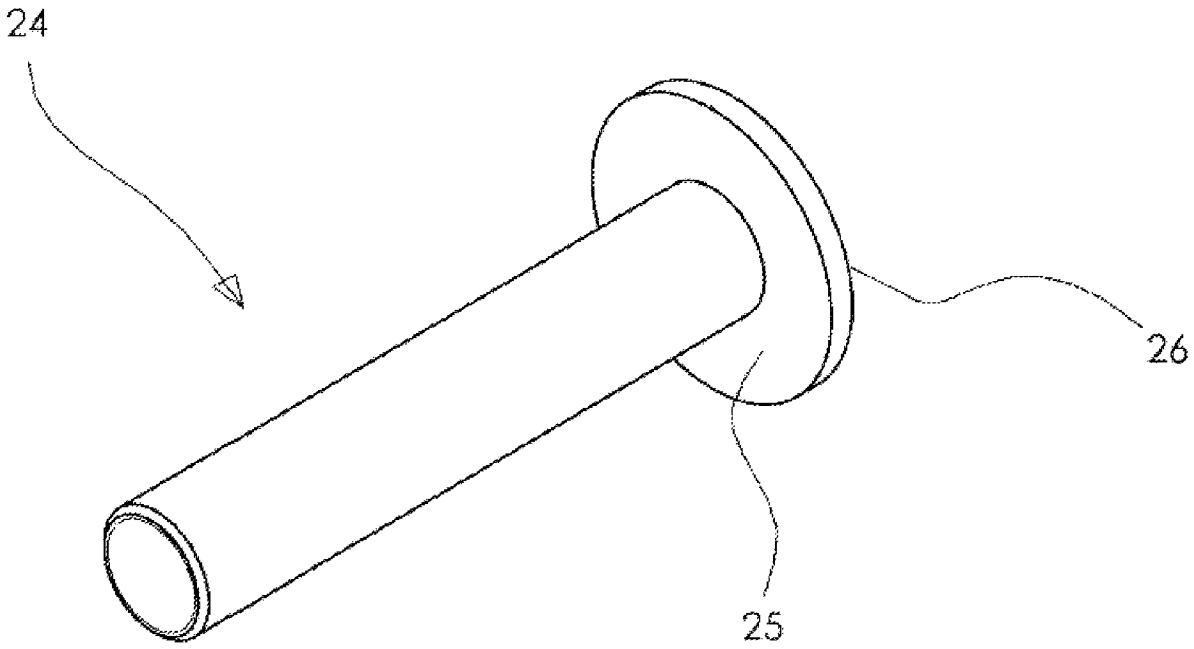
FIG. 10 shows a perspective representation of the second clamping screw 24.

The slot 22 is passed through by a second clamping screw 24 (see FIG. 10), which in the clamped state bears with the bottom surface 25 of the head 26 against the surface 27 of the circular pivot 15. The surface 27 stands at right angles to the slot 22. The threaded shank 28 of the second clamping screw 24 engages in the internal thread 29 in the attachment 3. The internal thread 29 has the same angle β to the bearing surface 23 as does the slot 22 (see FIGS. 4, 7 and 9).

As a result of production-related tolerances on the diameter of the tapered pivot 8 and on the diameter of the countersink 10, a greater or lesser sized gap is formed between the wall 30 on the extension 14 and the wall 31 on the attachment 3. This gap is compensated for by spacer plates 32. Depending on the size of the gap, a corresponding number of spacer plates 32 are inserted (see FIG. 7).

The extension 14 and the circular pivot 15 have a first borehole 33 and a second borehole 34. In these boreholes are seated a first clamping pin 35 and a second clamping pin 36. These two clamping pins pass through the boreholes 37 and 38 in the spacer plates 32 and serve for the positioning thereof (see FIGS. 3 and 7).

Figure 4:
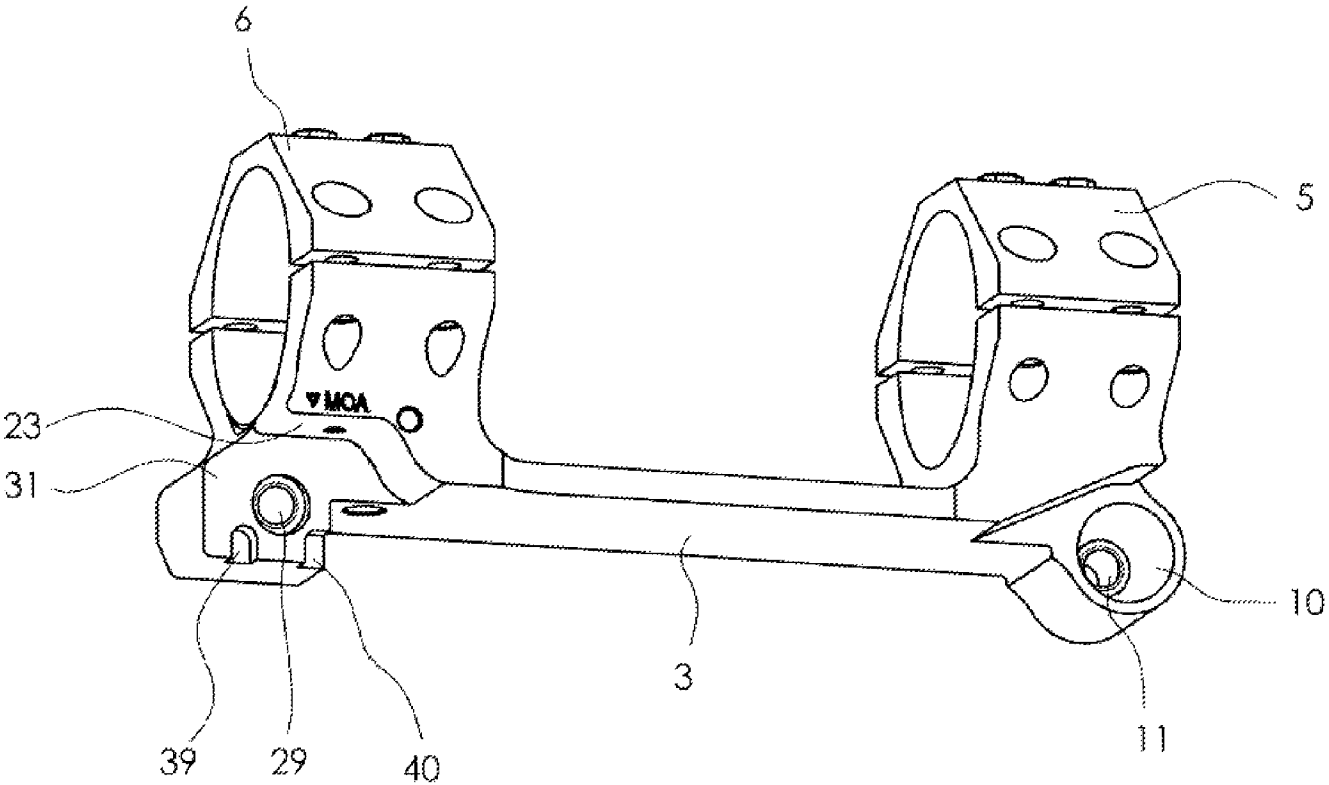
FIG. 4 shows a perspective representation of the attachment 3.

The recesses 39 and 40 ensure freedom from collision for the clamping pins 35 and 36 (see FIG. 4).

Figure 11:
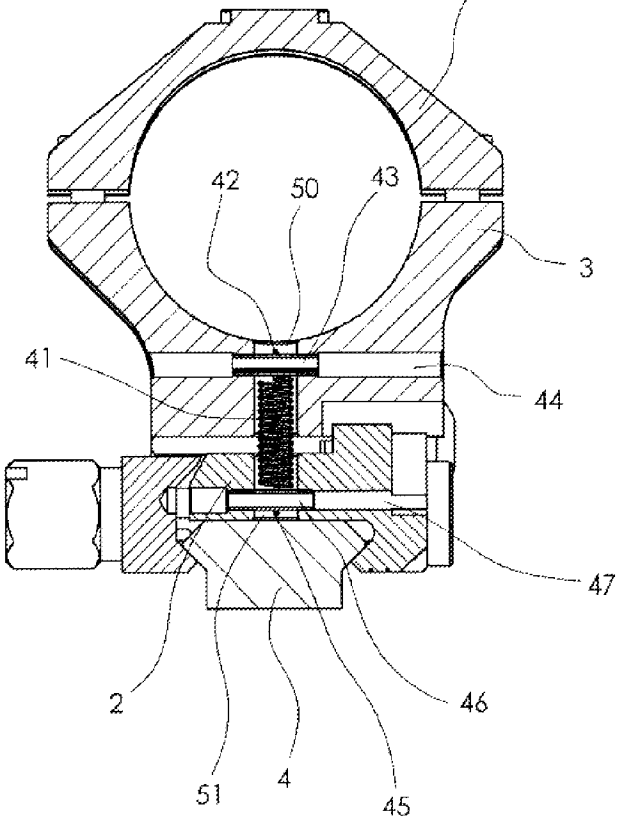
FIG. 11 shows a sectional representation through the region of the tension spring 41.

A tension spring 41 extends through the vertical borehole 50 in the attachment 3 and the vertical borehole 51 in the basic body 2 (see FIG. 11).

The first eyelet 42 of the tension spring 41 is passed through by a third clamping pin 43, which is seated in the borehole 44 in the attachment 3.

The second eyelet 45 of the tension spring 41 is passed through by a fourth clamping pin 46, which is seated in the borehole 47 in the basic body 2.

Figure 12:
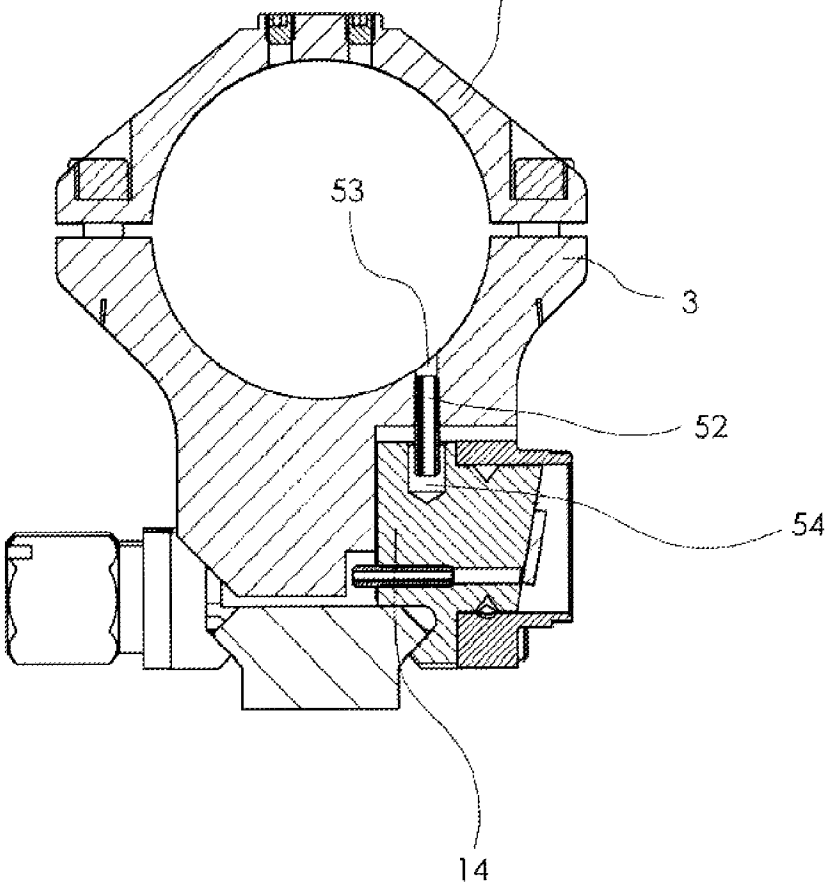
FIG. 12 shows a sectional representation through the region of the fifth clamping pin 52.

The fifth clamping pin 52 in the borehole 53 in the attachment 3 projects into the borehole 54 in the extension 14 in the basic body 2. The diameter of the borehole 54 is here slightly larger than the diameter of the clamping pin 52. This arrangement prevents the attachment 3 from being pushed too strongly away to the side when the second clamping screw 24 is loosened or tightened (see FIG. 12).

The execution of the adjustment of the forward tilt occurs in five steps:

1. Loosening of the first clamping screw 12.

One revolution of the screw is here sufficient.

2. Loosening of the second clamping screw 24.

Depending on the pitch of the thread, about two revolutions of the screw are sufficient. Since both clamping screws are now loosened, the compression spring 48 in the borehole 49 (see FIGS. 5 and 7) ensures that the tapered joint does not work loose but still remains rotatable about the hinge axis 13.

3. Through manual turning of the adjusting wheel 16, select the desired tilt angle.

The adjusting wheel 16 must here be turned to the point where the appropriate surface 20 makes contact with the bearing surface 23. The bearing surface 23 is always pulled by the tension spring 41 against the surfaces on the periphery of the adjusting wheel 16. Since, in the course of rotation from one surface to the next, the tension spring 41 is stretched and reslackened, a tangible detent is obtained in respect of each surface.

4. Tightening of the second clamping screw 24.

The angle β is chosen such that it is less than 90° and greater than the angle of self-locking of the material pairing of the wall 31 of the attachment 3 and the spacer plates 32.

Self-locking describes in mechanics the friction-induced resistance to the displacement of two adjacent bodies. As the self-locking angle is here denoted that angle on the inclined plane at which static friction is present. If the self-locking angle is exceeded, sliding friction is present and the two bodies are thus no longer self-locking. The size of the self-locking angle is here dependent on the surface roughness of the material pairing.

The attachment 3 is thus pulled with its bearing surface 23 against the surface 20 of the adjusting wheel 16 and at the same time with its wall 31 against the spacer plates 32, which are in turn pulled against the wall 30 on the extension 14. A positive connection is thus obtained. Were the second clamping screw 24 to run transversely to the direction of fire, i.e. at a 90° angle to the surfaces 30 and 31, a merely non-positive connection would be obtained, since in this case the attachment 3 would not be pulled with its bearing surface 23 against the surface 20 of the adjusting wheel 16. Should the angle β be chosen such that it is smaller than the self-locking angle—i.e. within the self-locking—of the material pairing of the wall 31 of the attachment 3 and the spacer plates 32, then merely a non-positive connection would likewise be obtained, since, in this case too, the attachment 3 is not pulled with its bearing surface 23 against the surface 20 of the adjusting wheel 16.

5. Tightening of the first clamping screw 12.

Points 1 and 2 and points 4 and 5, respectively, in the execution of the adjustment can also be carried out in the reverse order.

In principle, the telescopic sight mount can also be of two-part construction (not represented in the figures). This means that the region of the hinge with the front half-shell 5 and the region of the adjusting wheel 16 with the rear half-shell 6 have no connection. Both regions are in this case seated separately from each other on the Picatinny rail 4 or are connected to the weapon in accordance with the mount type.

In further embodiments of the invention (not represented in the figures), the extension 14 with circular pivot 15 and adjusting wheel 16 are not located at the rear end of the mount, viewed in the direction of fire, but at the front end thereof. Accordingly, the tapered joint is then situated at the rear end of the mount.

In the illustrative embodiment of the invention, the adjusting wheel 16 and the tapered pivot 8 are seated on the right-hand side of the telescopic sight mount, viewed in the direction of fire. These elements can equally be arranged on the left-hand side.

In a further embodiment (not shown in the Figures), the tapered pivot 8 can be part of the attachment 3 and the countersink 10 can hence be part of the basic body 2.

In a further variant, the extension 14 with circular pivot 15 can be part of the attachment 3. In this embodiment, the internal thread 29 for the second clamping screw 24 is hence located in the basic body 2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE SYMBOL LIST

1 telescopic sight mount
2 basic body
3 attachment
4 Picatinny rail
5 front half-shell
6 rear half-shell
7 telescopic sight
8 tapered pivot
9 borehole for first clamping screw 12
10 countersink
11 internal thread for first clamping screw 12
12 first clamping screw
13 hinge axis
14 extension
15 circular pivot
16 adjusting wheel
17 threaded pin as loss prevention device for the adjusting wheel 16
18 annular groove
19 internal thread in the adjusting wheel 16
20 surface
21 corrugation
22 slot
23 bearing surface
24 second clamping screw
25 bottom surface of the head 26 of the second clamping screw 24
26 head of the second clamping screw 24
27 surface of the circular pivot 15
28 threaded shank of the second clamping screw 24
29 internal thread in the attachment 3
30 wall on the extension 14
31 wall on the attachment 3
32 spacer plate
33 first borehole through extension 14 and circular pivot 15
34 second borehole through extension 14 and circular pivot 15
35 first clamping pin
36 second clamping pin
37 first borehole in the spacer plate 32
38 second borehole in the spacer plate 32
39 first recess in the attachment 3
40 second recess in the attachment 3
41 tension spring
42 first eyelet of the tension spring 41
43 third clamping pin
44 borehole in the attachment 3
45 second eyelet of the tension spring 41
46 fourth clamping pin
47 borehole in the basic body 2
48 compression spring
49 borehole for compression spring 48
50 vertical borehole in the attachment 3
51 vertical borehole in the basic body 2
52 fifth clamping pin
53 borehole for fifth clamping pin 52 in the attachment 3
54 borehole for fifth clamping pin 52 in the extension 14

What is claimed is:

1. A telescopic sight mount with adjustable forward tilt, wherein the mount comprises a basic body and an attachment and wherein in an assembled state of the mount a portion of the basic body and a portion of the attachment form a positive connection due to a clamping screw for the portions of the basic body and the arrangement which is arranged at an angle with respect to a bearing surface of the portion of the attachment that is smaller than 90° and larger than an angle that would result in a self-locking between a material of a wall of the attachment and a material of an object that is arranged between the portions of the basic body and the attachment and contacts the wall of the attachment.

2. The telescopic sight mount of claim 1, wherein the portion of the attachment comprises an extension comprising a circular pivot on which an adjusting wheel is rotatably mounted.

3. The telescopic sight mount of claim 2, wherein the adjusting wheel has on a periphery thereof a plurality of plane surfaces.

4. The telescopic sight mount of claim 3, wherein a distance of each plane surface of the plurality of plane surfaces to a rotational axis of the adjusting wheel corresponds to a specific angle of forward tilt.

5. The telescopic sight mount of claim 2, wherein a shell surface of the adjusting wheel has a pitch in the form of a spiral.

6. The telescopic sight mount of claim 1, wherein the mount comprises an additional clamping screw which connects portions of the basic body and the attachment which are different from the portions of the basic body and the attachment which form a positive connection.

7. The telescopic sight mount of claim 6, wherein one clamping screw extends through a circular pivot and the additional clamping screw extends through a hinge axis.

8. The telescopic sight mount of claim 1, wherein the mount further comprises a tension spring which holds the basic body and the attachment under tensile stress.

9. The telescopic sight mount of claim 1, wherein the clamping screw extends through a circular pivot.

10. The telescopic sight mount of claim 1, wherein portions of the basic body and the attachment which are different from the portions that form a positive connection form a part of a tapered pivot joint.

11. The telescopic sight mount of claim 10, wherein the tapered pivot joint comprises a tapered pivot comprised in the basic body and a countersink comprised in the attachment.

12. The telescopic sight mount of claim 10, wherein the tapered pivot joint comprises a tapered pivot comprised in the attachment and a countersink comprised in the basic body.

13. The telescopic sight mount of claim 1, wherein the object is a spacer plate.

* * * * *